US008857974B2

(12) United States Patent
Izawa et al.

(10) Patent No.: US 8,857,974 B2
(45) Date of Patent: Oct. 14, 2014

(54) DUPLEX PRINTING APPARATUS

(75) Inventors: Hideo Izawa, Narashino (JP); Yuuichi Yamazaki, Narashino (JP)

(73) Assignee: Miyakoshi Printing Machinery Co., Ltd., Chiba (JP)

( * ) Notice: Subject to any disclaimer, the term of this patent is extended or adjusted under 35 U.S.C. 154(b) by 182 days.

(21) Appl. No.: 13/434,371

(22) Filed: Mar. 29, 2012

(65) Prior Publication Data

US 2012/0249652 A1 Oct. 4, 2012

(30) Foreign Application Priority Data

Mar. 29, 2011 (JP) ..... 2011/71677

(51) Int. Cl.
*B41J 2/01* (2006.01)

(52) U.S. Cl.
USPC ..... 347/104

(58) Field of Classification Search
USPC ..... 347/16, 104; 101/222, 223; 242/358.2; 355/309
See application file for complete search history.

(56) References Cited

U.S. PATENT DOCUMENTS 6,050,191 A 4/2000 Enderle et al.
6,167,806 B1 * 1/2001 Chretinat et al. ..... 101/220

FOREIGN PATENT DOCUMENTS

JP 2005-335145 12/2005
JP 2010-099955 5/2010

* cited by examiner

*Primary Examiner* — Lam S Nguyen
(74) *Attorney, Agent, or Firm* — Cozen O'Connor

(57) ABSTRACT

A duplex printing apparatus comprising: a turnover unit 16 arranged at one of a site between the paper supply unit 2 and the feed roll unit 6*a* on the paper supply side and a site between the paper takeup unit 5 and the feed roll unit 6*b* on the paper takeup side, whereby the web of paper 3 is turned over through and is allowed to bypass the turnover unit; a mark sensor 15 arranged upstream in a direction of travel of the paper for detecting a timing mark 14 printed by the digital printer 4 on an under surface of the paper; and a control unit 7 operable in response to a detection value from the mark sensor for controlling the digital printer so that on the upper surface of the paper there is printed an image corresponding to an image printed on the under surface of the paper.

3 Claims, 6 Drawing Sheets

DUPLEX PRINTING APPARATUS

TECHNICAL FIELD

The present invention relates to a duplex printing apparatus for printing on both surfaces of a web of paper for rotary printing, using a digital printer such as an ink jet printer, an electrophotographic printer or the like.

BACKGROUND ART

As a conventional apparatus for printing on both surfaces of a web of paper for rotary printing with a digital printer, there exist an apparatus using two digital printers in which after an upper surface of the web of paper fed from a paper supply unit is printed on by a first digital printer, the web of paper is turned upside down and an under surface of the web of paper is printed on by a second digital printer (see JP 2010-99955 A), and alternatively, as shown in JP 2005-335145 A, an apparatus using a single digital printer in which after a web of paper is fed to travel through the digital printer to print on an upper surface thereof, the web of paper is turned upside down, and the web of paper is fed again to travel through the digital printer to print on an under surface of the web of paper.

In the former of the prior art, there is the problem that two expensive digital printers are needed for upper and under surfaces, making the installation costly and the apparatus large-sized. Such a printing apparatus of duplex printing specification also gives rise to the problem that, in producing a number of single-side printed products, only one of the printers is worked, making the equipment inefficient.

In the latter of the prior art in which the single digital printer is used to accomplish printing on both surfaces one by one, it is required that the web of paper first supplied from the paper supply unit, printed on one surface and taken up onto a paper takeup unit should be removed from its takeup stand and be carried back into the paper supply unit. In the paper supply unit, the web of paper needs to be reset on its paper supply stand so that it can be fed out to cause the other (unprinted) surface to face a printing head of the ink jet printer and thereby to be printed on later. In this case, where for reasons of printing data it is required to start later printing from an area on the other surface opposite to a first image printed, normally the web of paper is rewound onto a rewinding machine on offline. In the absence of the rewinding machine, the web of paper having been printed on before, is removed from the takeup stand, is carried again to the paper supply unit in which it is set on the paper supply stand, without printing on, is rewound onto the paper takeup unit, so that the first print by the precedent printing lies on the outermost of the roll, and is thereafter removed from the takeup stand and carried again to the paper supply unit which it is set on the paper supply stand, necessarily for later printing.

In the latter of the prior art, therefore, in which duplex printing is effected in an apparatus of single-side printing specification, the problems have arisen that it entails heavy burdens on carrying single-side printed rolled paper for web resetting, on working operations such as those for conveying rolled paper to make use of a rewinding machine and on equipment and working operations to secure safety in handling weighty materials and components such as mounting and dismounting rolled paper.

In view of problems as mentioned above, it is an object of the present invention to provide a duplex printing apparatus that is designed and adapted to efficiently print on both surfaces of a web of paper using a single digital printer.

DISCLOSURE OF THE INVENTION

In order to achieve the objection mentioned above, there is provided in accordance with the present invention in a first aspect thereof a duplex printing apparatus for printing, with a single digital printer, on both surfaces of a web of paper for rotary printing traveling over between a paper supply unit and a paper takeup unit, wherein it comprises: a pair of feed roll units arranged across the digital printer from each other in a direction of travel of the web of paper and each adapted to be driven synchronously with the paper supply and takeup units for feeding the web of paper to travel forwards and backwards while an upper surface of the traveling web of paper faces an under surfaces of the digital printer; a turnover unit arranged at one of a site between the paper supply unit and the feed roll unit on the paper supply side and a site between the paper takeup unit and the feed roll unit on the paper takeup side, whereby the traveling web of paper is turned over through, and is allowed to bypass, a turnover path of the turnover unit; a mark sensor arranged on at least one of sides across the digital printer from each other in a direction of travel of the web of paper and upstream in a direction of travel of the web of paper, an upper surface of which is being printed on by the digital printer, for detecting a timing mark which has been printed by the digital printer on an under surface of the web of paper; and a control unit operable in response to a detection value from the mark sensor for controlling the digital printer so that on the upper surface of the web of paper there is printed an image corresponding to an image that has been printed on the under surface of the web of paper.

The present invention also provides in a second aspect thereof a duplex printing apparatus for printing, with a single digital printer, on both surfaces of a web of paper for rotary printing traveling over between a paper supply unit and a paper takeup unit, wherein it comprises: a pair of feed roll units arranged across the digital printer from each other in a direction of travel of the web of paper and each adapted to be driven synchronously with the paper supply and takeup units for feeding the web of paper to travel forwards and backwards while an upper surface of the web of paper faces an under surface of the digital printer; a turnover unit whereby the web of paper fed from one of the paper supply and takeup units on one side is detoured around the digital printer and turned over to travel into the feed roll unit on the other side and is then fed to travel from the feed roll unit on the other side into the feed roll unit on the one side while an upper surface of the web of paper faces an under surface of the digital printer, and thereafter the web of paper from the feed roll unit on the one side is turned over again and threaded into the other of the paper supply and takeup units; a mark sensor arranged on at least one of sides across the digital printer from each other in a direction of travel of the web of paper and upstream in a direction of travel of the web of paper an upper surface of which is being printed on by the digital printer, for detecting a timing mark which has been printed by the digital printer on an under surface of the web of paper; and a control unit operable in response to a detection value from the mark sensor for controlling the digital printer so that on the upper surface of the web of paper there is printed an image corresponding to an image that has been printed on the under surface of the web of paper.

The present invention further provides in a third aspect thereof a duplex printing apparatus as mentioned in the preceding paragraphs, wherein it further comprises a travel distance detector for detecting a travel distance of the web of paper traveling with respect to the digital printer, the control unit being adapted to receive detection values by the travel distance detector and signals from the mark sensor to control timing of printing on the under surface.

In a duplex printing apparatus according to the present invention in the first aspect thereof wherein the turnover unit is disposed between the paper supply unit and the feed roll unit on the paper supply side as shown in FIG. 1, feeding the web of paper to travel forwards from the paper supply unit while bypassing the turnover unit allows the digital printer to print on the upper side (upper surface) of the web of paper. Then, by causing the web of paper to be taken up onto the paper takeup unit to be fed to travel backwards and wound back onto the paper supply unit and, thereafter, causing the web of paper from the paper supply unit to be passed through, and turned over by, the turnover unit and to be fed to travel forwards again, the digital printer is allowed to print on the under side (under surface) of the web of paper, in the course of turnover and forward feed of travel.

Also, in another form of the duplex printing apparatus according to the invention in the first aspect thereof wherein the turnover unit is disposed between the paper takeup unit and the feed roller unit on the paper takeup side as shown in FIG. 4, feeding the web of paper from the paper supply unit to travel forwards allows the digital printer to print on the upper surface of the web of paper. The web of paper is then passed through, and turned over, by the turnover unit to turn its printed side down. Then, by causing the web of paper with its printed side positioned down to be taken up onto the paper takeup unit and to be fed to travel backwards with its printing terminal end changed into a leading end, while bypassing the turnover unit and with its unprinted surface (under surface) positioned up, towards the paper supply unit, the digital printer in this course of backward travel is allowed to print on the under surface of the web of paper. This embodiment allows the digital printer to print on both upper and under surfaces during one cycle of reciprocatory travel, i.e., the forward travel and, via the paper takeup unit, backward travel, of the web of paper supplied from the paper supply unit.

In one mode of operation of the duplex printing apparatus according to the present invention in the second aspect thereof, feeding the web of paper from the paper supply unit to travel forwards allows printing on the upper surface of the web of paper, the web of paper being then taken up onto the paper takeup unit. Then, by causing the web of paper on the paper takeup unit, with its printed terminal end changed into a leading end, to be turned over through the turnover unit and then to be threaded through the feed roll unit on the paper supply side and to be fed to travel forwards from the feed roll unit on the paper supply side into the feed roll unit on the paper takeup side, it is possible to print on the under surface of the web of paper with the digital printer. Duplex printing is ended then by causing the web of paper to be passed through the turnover unit and to be taken onto the paper supply unit.

In another mode of operation of the duplex printing apparatus according to the invention in the second aspect thereof, printing on the upper surface of the web of paper by feeding the web of paper normally to travel forwards from the paper supply unit, is followed by taking up the web of paper onto the paper takeup unit whereafter the web of paper on the paper takeup unit is fed to travel backwards and wound back to the paper supply unit and the web of paper with its printed terminal end changed into a leading end is turned over through the turnover unit and fed to pass from the feed roll unit on the paper takeup side into the feed roll unit on the paper supply side. The web of paper is then fed to travel so as to be wound onto the paper takeup unit from the feed roll unit on the paper supply side. It is thus allowed to effect printing on the under surface with the digital printer from a portion of the web of paper corresponding to the leading end of printout on the upper surface and to meet with an application in which there is a limitation in printing date and the like which require commencing the under surface printing with a first area as in the upper surface printing.

According to a duplex printing apparatus of the invention in the third aspect thereof, printing by the digital printer on the under surface of the web of paper is controlled in response to a detection signal from the mark sensor for detecting an image on the upper surface and a detection signal from the travel distance detector for detecting a travel distance of the web of paper, thereby making it possible to control timing of printing images on the under surface in conformity with printing of images on the upper surface and to prevent a printed image on the under surface from deviating from the image printed on the upper surface.

Further, according to a duplex printing apparatus of the present invention operable as mentioned above, it is possible to efficiently yield duplex printed products with a less costly printing apparatus using a single digital printer of single-side printing specification.

Also, operations for mounting, dismounting, conveyance, etc of rolled paper as have been needed until a duplex printed product is yielded are made unnecessary; hence effects are achieved not only of reducing the cost of equipment but also of improving the operation efficiency. And, the time of preparatory work is reduced, and the substantial time of production and the amount of production per unit time are increased, thereby ameliorating the cost of product.

BEST MODES FOR CARRYING OUT THE INVENTION

Figure 1:
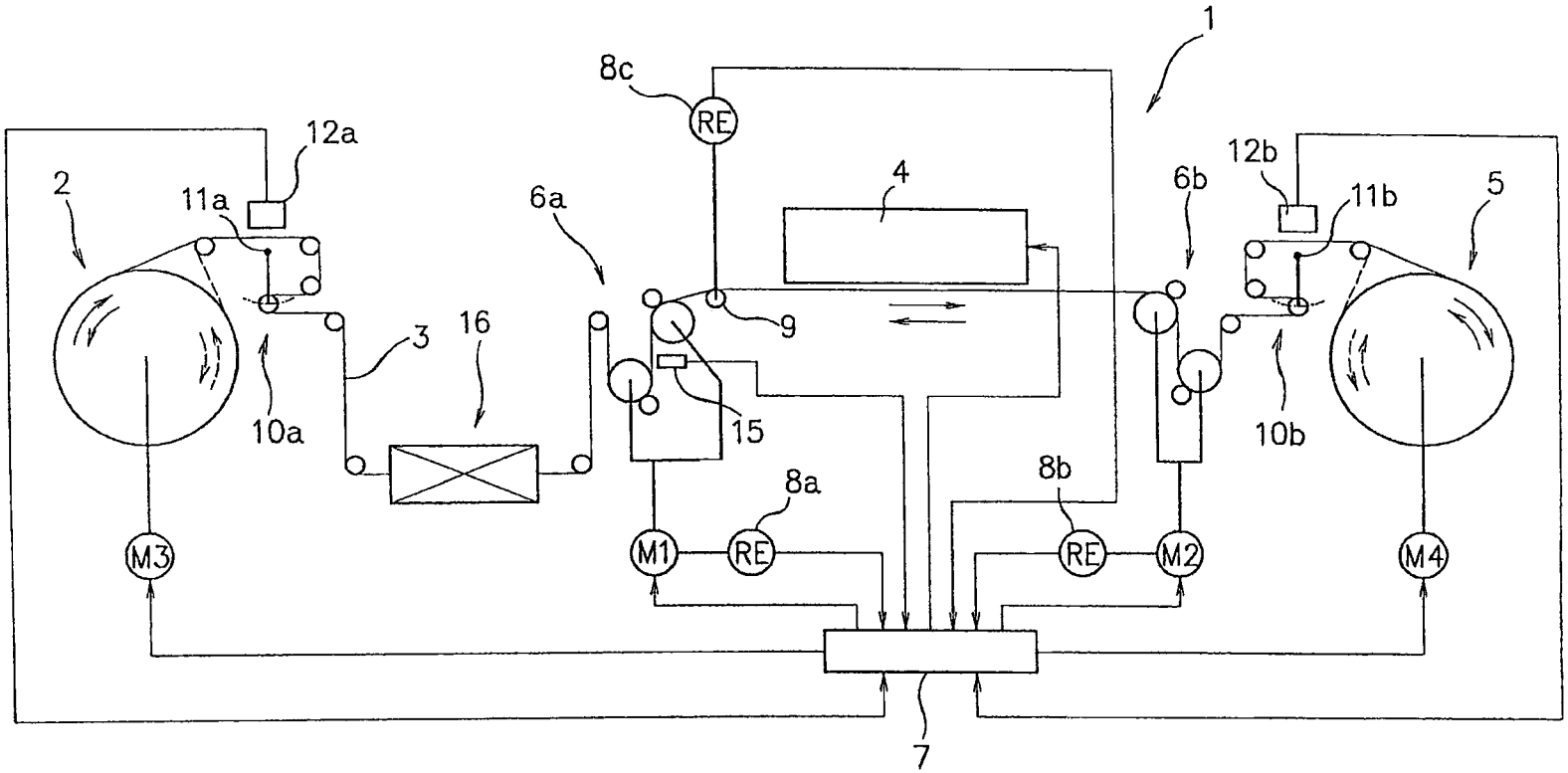
FIG. 1 is an explanatory view diagrammatically illustrating a first form of implementation of the present invention.

FIG. 1 shows a duplex printing apparatus 1 according to the first form of implementation of the present invention. The basic makeup of duplex printing apparatus 1 is such that a web of paper 3 for rotary printing supplied from a paper supply unit 2 is printed on its upper surface by an ink jet printer 4 as an example of a digital printing press, and then taken up by a paper takeup unit 5. And, the web of paper 3 for rotary printing is here designed and intended to be fed to travel forwards, i.e., from the paper supply unit 2 towards the paper takeup unit 5, and also to travel backwards, i.e., from the paper takeup unit 5 towards the paper supply unit 2.

Upstream and downstream of the ink jet printer 4 in the direction of forward travel of the web of paper 3 there are provided feed roll units 6*a* and 6*b* driven controllably to rotate both normally or forwards and reversely or backwards, singly by drive motors M1 and M2, respectively. By causing the feed roll units 6*a* and 6*b* to be driven controllably to rotate forwards and backwards by drive motors M1 and M2, respectively, the web of paper 3 for rotary printing can be fed to travel forwards, i.e., from the paper supply unit 2 towards the paper takeup unit 5 and to travel backwards, i.e. from the paper takeup unit 5 towards the paper supply unit 2.

Here, the motors M1 and M1 for the feed roller units 6*a* and 6*b* when driven to feed the web of paper 3 to travel both forwards and backwards are controlled in rotation so as to ensure that the rate of feed of the web of paper 3 by the feed roller unit then switched down-stream is made slightly higher than that of the web of paper 3 by the feed roller unit then switched upstream, whereby the web of paper 3 traveling beneath the ink jet printer 4 has a right tension imparted thereto.

The paper supply unit 2 and the paper takeup unit 5 have a paper feed shaft and a paper takeup shaft, respectively, by which a paper cylinder of roll paper is held securely. These shafts are driven by motors M3 and M4, respectively, so that they concurrently rotate normally and also concurrently rotate reversely. Thus, the paper supply and takeup units 2 and 5 both feed out and take up the web of paper 3 in accordance with the rates of forward and backward feed of the web of paper 3 by the feed roll units 6*a* and 6*b*, respectively.

The motors M1, M2, M3 and M4 are controlled in rotation by a control unit 7. And, rotary encoders 8*a* and 8*b* are provided to detect rotations (rotational positions) of the motors M1 and M2 for driving the feed roller units 6*a* and 6*b*, respective values of their detection being fed back to the control unit 7.

Also, upstream of the ink jet printer 4 in forward feed direction there is provided a free roll 9 rotating to follow travel of the web of paper 3. The rotation of the free roll 9 is detected as a travel distance of the web of paper 3 by a rotary encoder 8*c* and a value of its detection is fed back to the control unit 7, wherein the free roll 9 and the rotary encoder 8*c* detecting its rotation constitutes a travel distance detector for detecting a travel distance of the web of paper 3.

In the form of implementation of the invention illustrated in FIG. 1, between the paper supply unit 2 and the feed roller unit 6*a* on the paper supply side and between the paper takeup unit 5 and the feed roller unit 6*b* on the paper takeup side, there are provided dancer rolls 10*a* and 10*b*, respectively, having portions of the web of paper 3 rolled on them for imparting tensions to the web of paper. The tensions imparted by the dancer rolls 10*a* and 10*b* to the web of paper 3 are generated by applying selected rotation torques to dancer roll primary shafts 11*a* and 11*b* supporting the dancer rolls 10*a* and 10*b*, respectively. Means for generating such a rotation torque may be by one that can be selected from a way of applying a weight to a rotary lever (not shown) anchored to the dancer roll primary shaft 11*a*, 11*b*, a way of applying a fixed force to a bellofram cylinder and varieties of other like ways.

A deviation in position of the dancer roll 10*a*, 10*b* is detected by a dancer position detector 12*a*, 12*b* disposed opposite to the rotary lever fixed to the dancer roll primary shaft 11*a*, 11*b*. The rotation of the shaft of rolled paper in the paper supply unit 2, the paper takeup unit 5, is thus controlled in accordance with the deviation in position of the dancer roll 10*a*, 10*b* detected by the dancer position detector 12*a*, 12*b*.

To wit, a movement of the dancer roll 10*a*, 10*b* is detected by the dancer position detector 12*a*, 12*b*. And, so that the dancer roll 10*a*, 10*b* is held at a predetermined position, a signal from the dancer position detector 12*a*, 12*b* is fed to the control unit 7, and the rotary drive of the rolled paper in its feed direction, its takeup direction in the paper supply unit 2, the paper takeup unit 5 is controlled by control signals from the control unit 7 to the third and fourth drive motors M3, M4.

In the makeup mentioned above, the synchronous feed operation of the feed roll units 6*a* and 6*b* in each of the forward and backward directions maintains the tension of the web of paper 3 predetermined and appropriate each between the rolled paper in the paper supply unit 2 and the feed roll unit 6*a* and between the rolled paper in the paper takeup unit 5 and the feed roll unit 6*b* and between the both feed roll units 6*a* and 6*b*. While the tension is being so maintained, the web of paper 3 can be switched into either forward or backward direction of travel.

Figure 2:
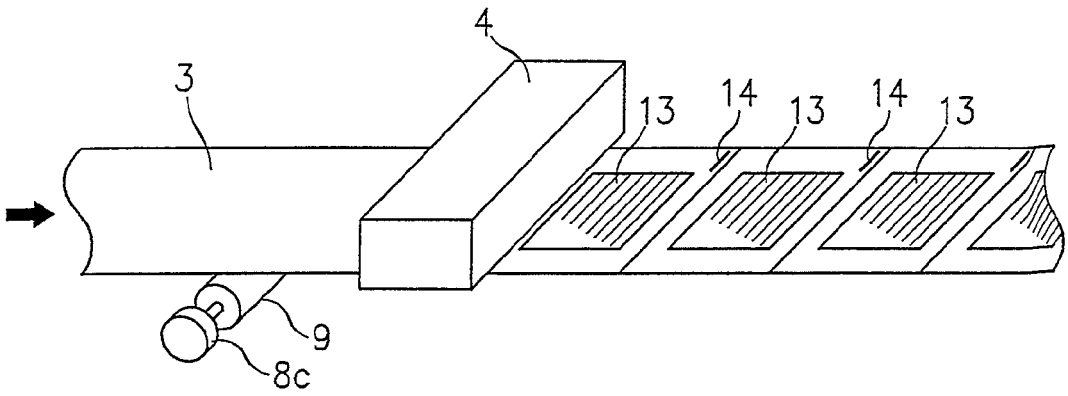
FIG. 2 is an explanatory view diagrammatically illustrating a state of printing with an ink jet printer in the first form of implementation.

With the ink jet printer 4, as shown in FIG. 2 consecutive images 13 are printed continuously on the upper side (upper surface) of a web of paper 3 for rotary printing while the web of paper 3 is being fed forwards. And, together with each image 13, a timing mark 14 is printed at an appropriate position associated therewith.

The feed roller unit 6*a* on the paper supply side is provided with a mark sensor 15 so as to be opposite to an under side (under surface) of the web of paper 3 traveling through this feed roll unit 6*a*. The mark sensor 15 is here designed to detect the timing mark 14 for an image 13 on the web of paper 3 turned over upstream of that feed roll unit 6*a* and traveling forwards, the timing mark 14 and the image 13 having been printed before the web of paper 3 is turned over.

Intermediate between the dancer roll 10*a* and the feed roll unit 6*a* upstream of the ink jet printer 4, there is arranged a turnover unit 16 for turning from upper to under the web of paper 3 traveling therebetween.

Figure 3:
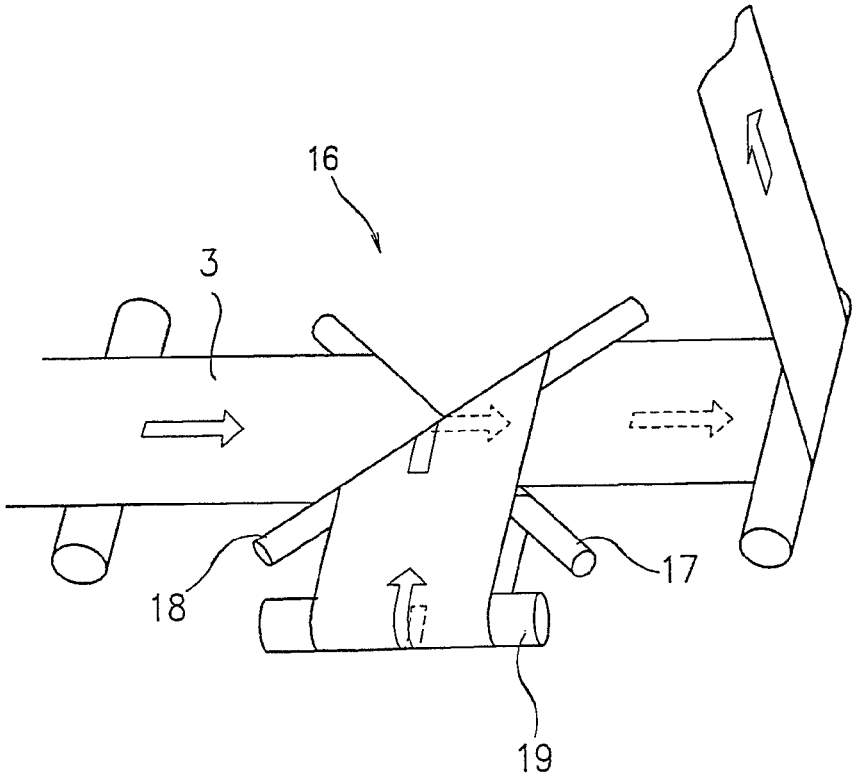
FIG. 3 is an explanatory view illustrating a turnover unit using a turn bar in the first form of implementation.

FIG. 3 shows an embodiment of the turnover unit 16 that is of turnbar type in which a first and a second tilting turnbar 17 and 18 are disposed orthogonally and both inclined at an angle of 45 degrees with respect to the direction of travel of the web of paper 3. A third turnbar 19 is arranged laterally of the first and second turnbars 17 and 18 and parallel to the direction of travel of the web of paper 3. Thus, for example, the web of paper 3 traveling in the forward direction is wound over the first tilting turnbar 17 to turn in a direction of 90 degrees, then wound over the parallel turnbar 19 to turn in a direction of 180 degrees and then wound over the second tilting turnbar 18 to turn in a direction of 90 degrees whereby the web of paper 3 as it is turned upside down is fed to travel downstream in the direction of forward travel. When the web of paper 3 is traveling backwards, the second tilting turnbar 18 is positioned to lie upstream, and the web of paper 3 as it is turned upside down is fed to travel downstream in the direction of backward travel.

In the turnover unit 16, note further that the web of paper 3 can also bypass, without passing through, the turnover path comprising the turnbars 17, 18 and 19.

Mention is made below of a duplex printing operation for a web of paper 3 with the duplex printing apparatus 1 so constructed as described above.

Referring back to FIG. 1, the web of paper 3 from the paper supply unit 2 is threaded without passing through, thus while bypassing, the turnover path of the turnover unit 16, and the feed roll unit 6*a* on the paper supply side and the feed roll unit 6*b* on the paper takeup side are synchronously driven to feed the web of paper to travel forwards. And, on an upper side (upper surface in the printing area) of the web of paper there are consecutively printed by the digital printer 4 an image 13 for each area and a timing mark 14 associated with the image 13.

After printing on the upper surface of the web of paper 3 has been completed and takeup of a portion of printout thereon by the paper takeup unit 5 has been finished, the two roller units 6*a* and 6*b* and the paper supply and takeup units 2 and 5 are reversely operated to cause the portion of printout on the upper surface of the web of paper 3 to be wound back in the paper supply unit 2 in the state that printing by the ink jet printer 4 is suspended. Thereafter, the web of paper 3 is cut between the paper supply unit 2 and the feed roll unit 6*a* on the paper supply side. One portion of the cut web of paper extending from the paper supply unit 2 is passed with its end in the lead into the turnover unit 16 where it is turned over, and is then threaded through the upstream and downstream feed roller units 6*a* and 6*b* and tied to the other portion of the cut web of paper 3 on the side of the paper takeup unit 5.

Next, by being fed to travel forwards, the web of paper 3 passing through the turnover unit 16 is fed to travel having its under surface (unprinted surface) turned upside and in this state passed under the ink jet printer 4 whereby as in upper surface printing mentioned above, images 13 and timing marks 14 respectively associated therewith are printed on the under surface of the web of paper 3, which is then taken up by the takeup unit 5.

In this state, the web of paper 3 is traveling forwards as its printout previously made by upper surface printing faces downwards. The timing marks 14 for the images 13 then printed on the upper surface are detected by the mark sensor 15 provided in the feed roll unit 6*a* on the paper supply side. A detection signal from the mark sensor 15 and a detection signal from the rotary encoder 8*c* are furnished into the control unit 7. The control unit 7 provides the ink jet printer 4 with a control signal by computation based on these signals whereby a printout on the under surface of the web of paper 3 is made so as to correspond in position to or match in position with the printout on the upper surface. Thus, for example, on the under side of images printed on the upper surface from the first image there can be printed images of the under surface from the first image in order with their printing data matched with each other.

Note further that images to be printed on the under surface can be made matched with the images on the upper surface without receiving a signal from the rotary encoder 8*c* for the free roll 9 but by timings by detection values of the mark sensor 15.

In this manner, according to this form of implementation, an image to be printed on the under surface of a web of paper can be printed corresponding to an image previously printed on its upper surface. To wit, printouts on the under surface can be printed in the same order as that of printouts on the upper surface.

In FIG. 1, note here that the arrows shown indicate the forward and backward directions of rotation of each of the rolls in the paper supply unit 2 and the paper takeup unit 5, of which the solid arrows represent the case of printing on an outer side surface of the web of paper 3 wound in the form of a roll and the broken arrows represent the case of printing on an inner side surface of the web of paper 3 wound in the roll form.

In the form of implementation mentioned above, it should be noted that a timing mark 14 printed accompanying each image 13 need not necessarily be printed separately of the image 13 if in part of each image 13 there is a common portion of image that can be detected by the mark sensor 15.

Also, the mark sensor 15 which is placed upstream of the ink jet printer 4 may be placed further upstream, or downstream, of the feed roll unit 6*a* which is placed upstream of the ink jet printer 4.

It should also be noted that while the feed roll unit 6*a* and 6*b* in the form of implementation illustrated are shown each to use a pair of rolls driven by the motor M1, M2 and each having the web of paper 3 wound thereon in the form of S, they may each be made up of a single roll in combination with a nip roll.

Further, while each of the motors M3 and M4 used to drive the shaft of roll paper at the paper supply unit 2 and the paper takeup unit 5 can, respectively, be a servo motor, stepping motor or the like, it may be selected from a variety of ones whose rotation can controllably be switched between normal and reverse.

Figure 4:
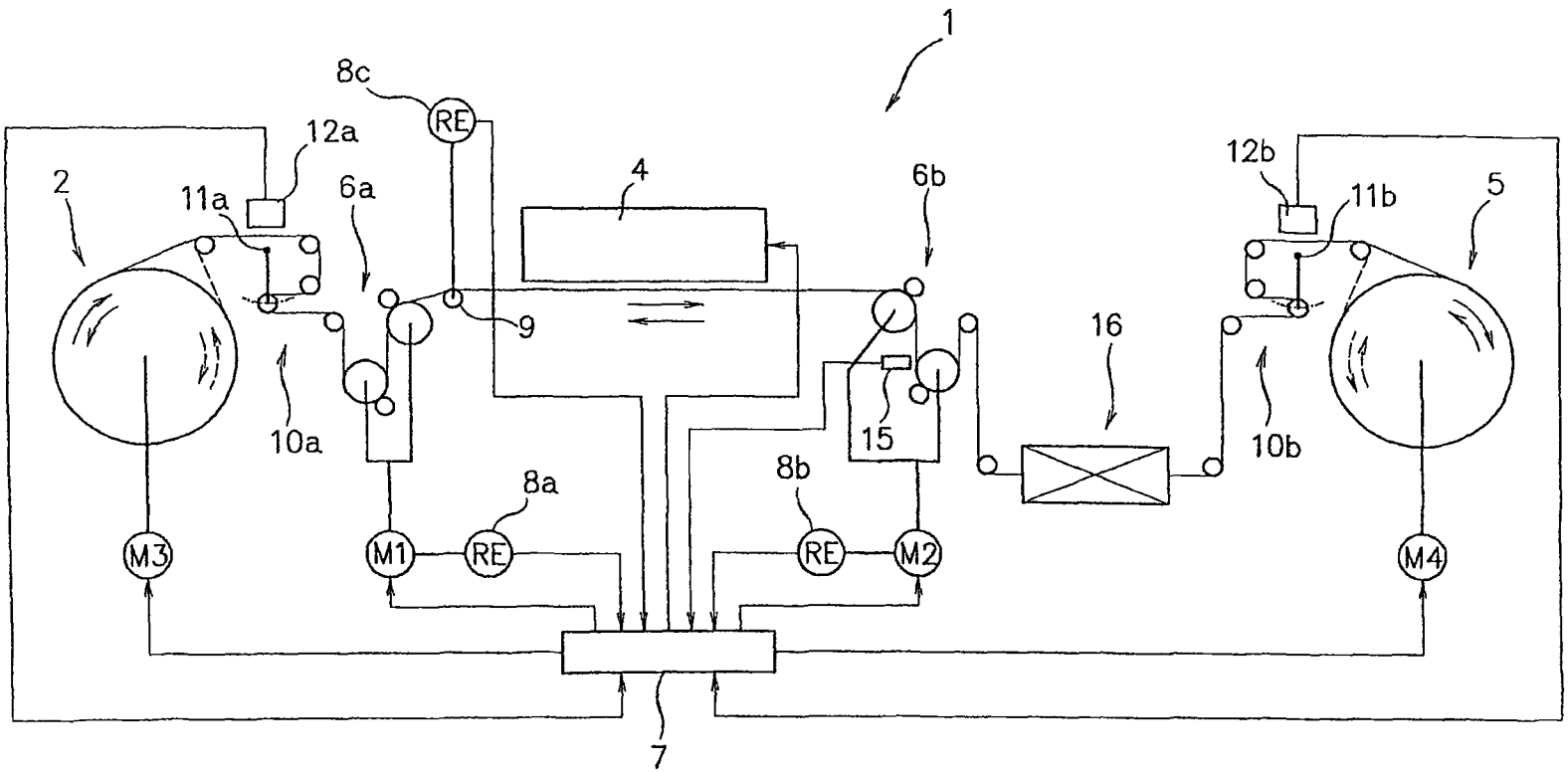
FIG. 4 is an explanatory view diagrammatically illustrating a second form of implementation of the present invention.

FIG. 4 shows a second form of implementation of the present invention which is applicable to where there exists no limitation by printing data or the like in mutual images on upper and under surfaces and in which while a web of paper 3 is traveling forwards and backwards in reciprocation with respect to an ink jet printer 4, the upper and under surfaces of the web of paper which is turned over are printed on.

In this second form of implementation, a turnover unit 16 is interposed between the feed roll unit 6*b* on the paper takeup side and the paper takeup unit 5. Also, a mark sensor 15 is here arranged at a position in the feed roll unit 6*b* on the paper takeup side for detecting timing marks 14 on the under surface of the web of paper 3 passing therethrough.

Mention is made below of an operation of the second form of implementation.

While the web of paper 3 from the paper supply unit 2 is being threaded through the ink jet printer 4 and the turnover unit 16 into the paper takeup unit 5, the web of paper 3 is driven to travel forwards between the two feed roll units 6*a* and 6*b*. Images 13 and timing marks 14, comprising an image 13 and its accompanying timing mark 14 for each area, are consecutively printed by the ink jet printer 4 on the upper side (upper surface) of the web of paper. After that, the web of paper 3 is turned over through the turnover unit 16 to turn its upper side printout down and taken up into the paper takeup unit 5.

After the web of paper 3 has been printed out on the upper surface and, as the printout faces downwards, has been taken up into the paper takeup unit 5, the web of paper 3 is cut at a side of its takeup trailing end. This end now as a leading end of the cut web of paper 3 is threaded while bypassing the turnover unit 16 and is tied to an end of the cut web of paper 3 located upsteam. The web of paper 3 now made again continuous and having its unprinted under surface made upper is fed to travel backwards and images are printed on the under surface by the ink jet printer 4. The web of paper 3 is then taken up on the paper supply unit 2 now reversely in rotation.

Then, the timing marks for the images previously printed on the upper surface are detected by the mark sensor 15 and a travel distance of the web of paper is detected by the rotary encode 8*c* for the free roll 9. Printing by the ink jet printer 4 is matched with these detection values to effect printing on the under side identically in position to the facial printing on the upper side. This is the case where no limitation exists by printing data or the like in images between the upper and under surfaces, and the order of images in printing on the under surface and that in printing on the upper surface are reversed.

In a modification of the form of implementation shown in FIG. 4 in which after images are printed on the upper surface of the web of paper 3 fed to travel forwards from the paper supply unit 2, the web of paper 3 is turned over through the turnover unit 16 to turn the unprinted under surface up, is taken up by the paper takeup unit 5. Next, the web of paper 3 is allowed to bypass the turnover unit 16, and not printed by the ink jet printer 4 is fed to travel backwards from the paper takeup unit 5 and taken up onto the paper supply unit 2. Thereafter, the web of paper 3 is fed to travel forwards from the paper supply unit 2 towards the paper takeup unit 5 and in the meantime the unprinted under surface (upper side) is subjected to printing by the ink jet printer 4. It is thus made possible to print images on the under surface in order from their first image in accordance with printing data matched with that of printing on the upper surface.

Figure 5:
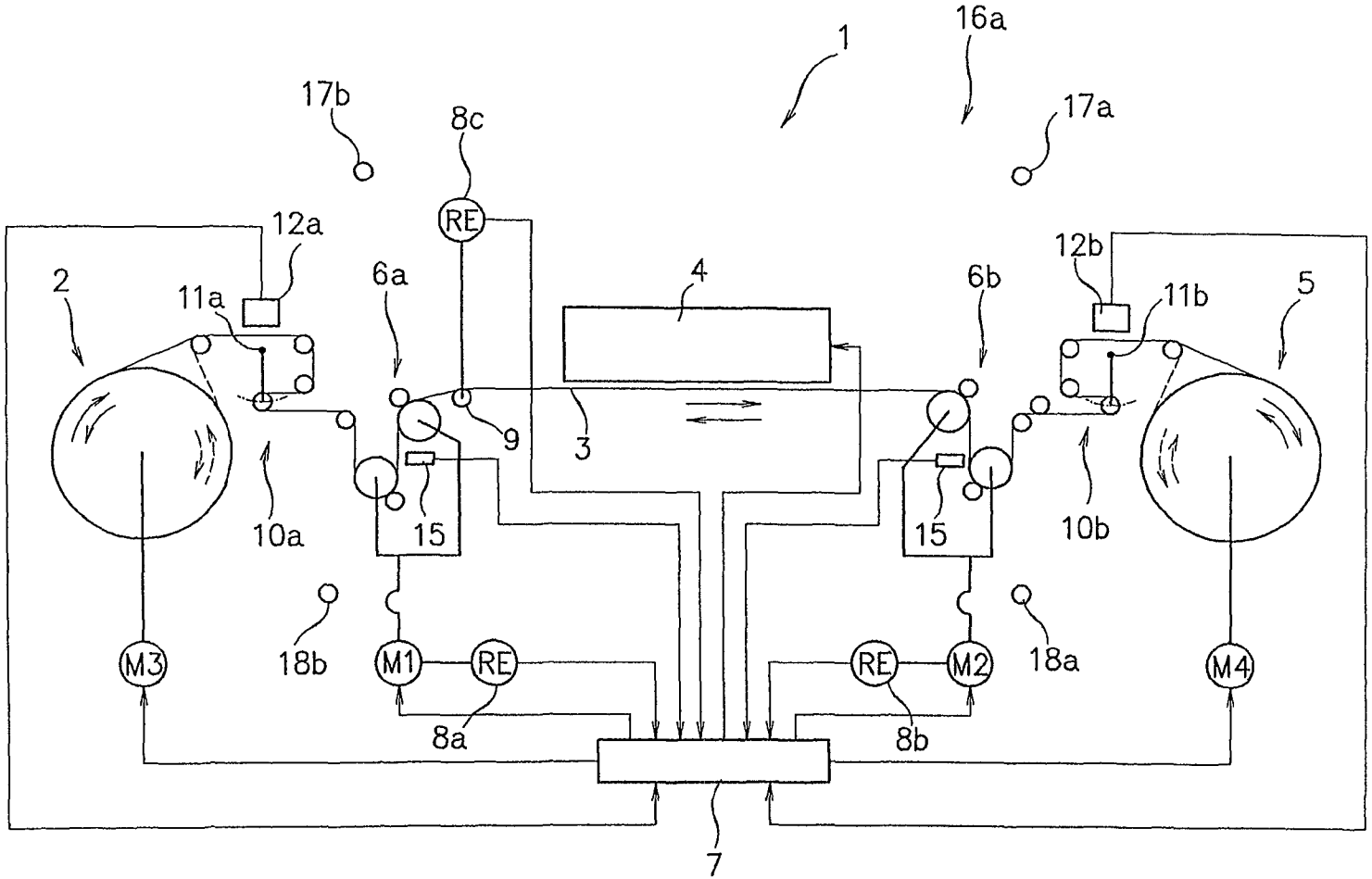
FIG. 5 is an explanatory view diagrammatically illustrating a third form of implementation of the present invention.
Figure 6:
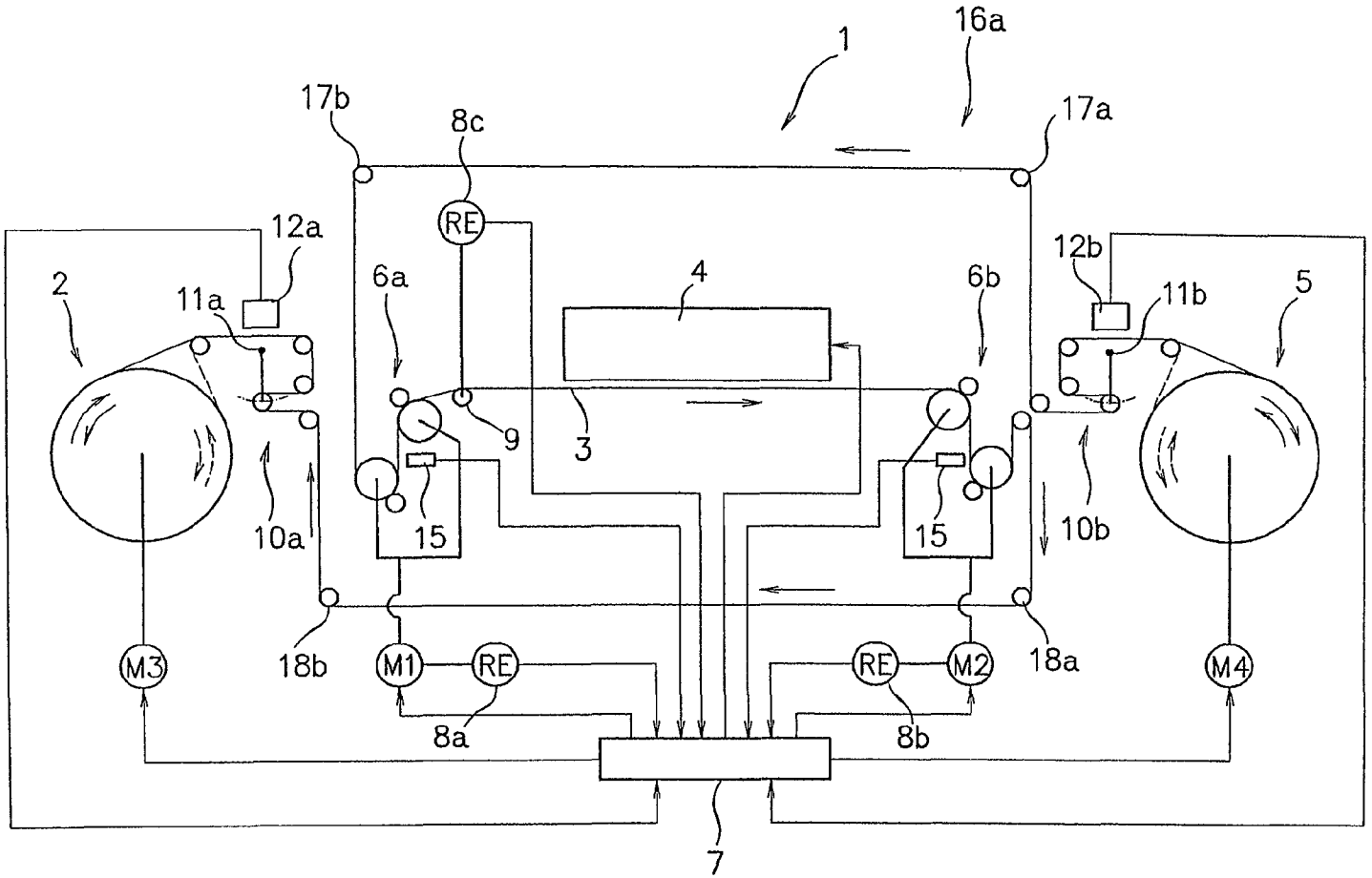
FIG. 6 is a view explanatory of an operation of the third form of implementation.

FIGS. 5 and 6 show a third form of implementation of the present invention in which the turnover unit 16 made up of a turn bar as mentioned above is substituted with a turnover unit 16*a* of detouring makeup.

The turnover unit 16*a* comprises two sets of two guide rolls 17*a* and 17*b*; 18*a* and 18*b* which are positioned respectively on an upper side and an under side of the printing area of the ink jet printer 4 so that they are respectively spaced apart in a direction of travel of the web of paper 3.

In this third form of implementation as shown in FIG. 5, printing is first effected on the upper surface of the web of paper 3 which is threaded without passing through the turnover unit 16*a*. In this case, the web of paper 3 from the paper supply unit 2 is fed to travel forward and in the meantime images are printed on the upper surface (upper side) of the web of paper 2 which is then taken up by the paper takeup unit 5.

Next, while after printing on the upper surface is ended, printing is thus effected on the under surface of a web of paper 3 taken up into the paper takeup unit 5, mention is made of an operation of printing on the under surface in the case where there is no limitation in printing data between the upper and under surfaces to be printed on, i.e., where images are printed on the under surface identically or correspondingly in position to on the upper surface when the web is a sheet of paper. Reference is made to FIG. 6.

The takeup trailing end of the web of paper 3 taken up onto the paper takeup unit 5 and whose upper surface has been printed on is wound on the upper guide rolls 17*a* and 17*b* of the turnover unit 16*a* and threaded into the paper supply side of the feed roll unit 6*a* on the paper supply side. In this state, the web of paper 3 is turned over. And, of the web of paper 3 fed to pass forwards from the feed roll unit 6*a* on the paper supply side into the feed roll unit 6*b* on the paper takeup side, the unprinted under surface is turned upward facing the ink jet printer 4. Then, the web of paper 3 is fed to travel through the feed roll unit 6*b* on the paper takeup side, is wound on the lower guide rolls 18*a* and 18*b* of the turnover unit 16*a* to be threaded backwards and is taken up onto the paper supply unit 2.

On the under surface of the web of paper 3 in this state, there are now printed images by the ink jet printer 4. The paper supply and takeup units 2 and 5 are then rotated reversely to cause the web of paper 3 to be fed out from the paper takeup unit 5 and taken onto the paper supply unit 2.

Then, the images (timing marks) on the upper surface of the web of paper passing through the feed roll unit 6*a* on the paper supply side are detected by the mark sensor 15 positioned there. In response to detection values by the mark sensor 15 and to detection values from the rotary encoder 8*c* for the free roll 9, timings of the ink jet printer 4 to print on the under surface are controlled to effect printing on the under surface corresponding in position to printing on the upper surface of the web as a sheet of paper.

Mention is made below of an application of duplex printing in which with an upper surface previously printed on by paper threading as shown in FIG. 5, it is required for the order of printing images on a under surface to be matched with the order of images printed on the upper surface if there is a limitation in printing data or the like to printing on the upper surface of a web of paper 3, i.e., if there exists the so-called limitation in printing date or the like.

Figure 7:
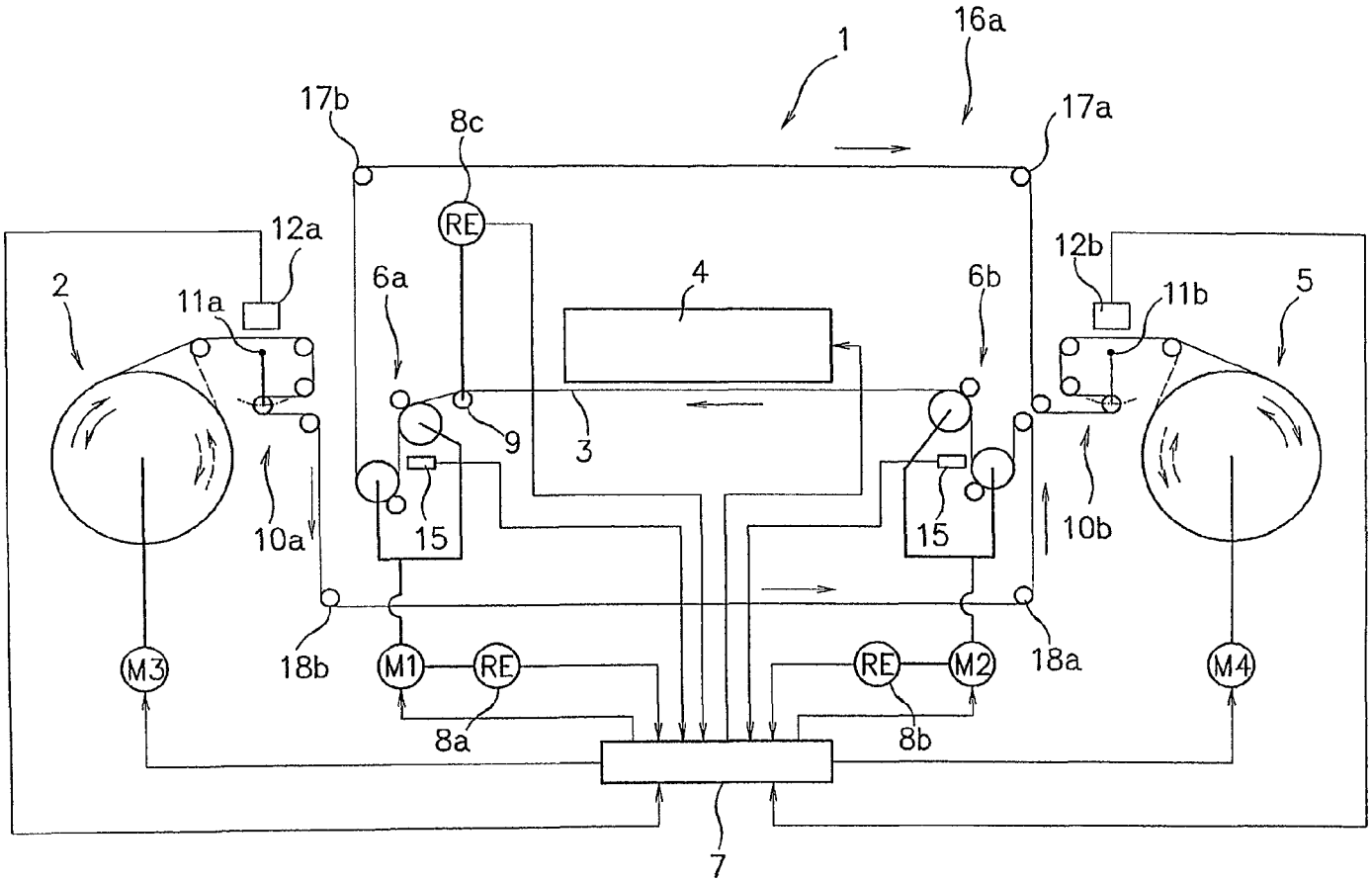
FIG. 7 is a view explanatory of another operation of the third form of implementation.

After printing on the upper surface of the web of paper 3 is finished, the web of paper 3 taken up by the paper takeup unit 5 as shown in FIG. 5 is first fed as it is to travel back to be taken up onto the paper supply unit 2. Then, the web of paper 3 is cut between the paper supply unit 2 and the feed roll unit 6*a* on the paper supply side and the web of paper 3 from the paper supply unit 2 is passed as shown in FIG. 7 to initiate printing on the under surface.

To initiate printing on the under surface, the web of paper taken up on the paper supply unit 2 and whose upper surface has been printed on is passed through the dancer roll unit 10*a* and wound on the lower guide rolls 18*a* and 18*b* in the turnover unit 16, and is passed from the feed roll unit 6*b* on the paper takeup side into the feed roll unit 6*a* on the paper supply side, wound on the upper guide rollers 17*a* and 17*b* in the turnover unit 16*a* and taken up onto the paper takeup unit 5. In the meantime in which the web of paper is fed to travel from the feed roll unit 6*b* on the paper takeup side to the feed roll unit 6*a* on the paper supply side, images are printed on the under surface by the ink jet printer 4 between the two feed roll units 6*a* and 6*b*. This under surface printing is controlled in response to detection values from the mark sensor 15 detecting the images (timing marks) printed on the upper surface and from the rotary encoder 8*c* detecting rotation of the free roll 9 and is effected by matching the printing date to the images on the upper surface.

Wile the direction of travel of the web of paper 3 with respect to the ink jet printer 4 is then reversed from upper to under printing, printing data in both printing operations can be matched in controlling the printing operations of the ink jet printer 4.

While in FIGS. 1 and 4 which show the first and second form of implementation, the turnover 16 in the first form of implementation is illustrated as arranged between the paper supply unit 2 and the feed roll unit 6*a* on the paper supply side and the turnover unit 16 in the second form of implementation is illustrated as arranged between the paper takeup unit 5 and the feed roll unit 6*b* on the paper takeup side, it should be noted that both the turnover units 16 may have been preliminarily arranged and so positioned as mentioned above so that the first and/or second form of implementation can readily be run whenever occasion demands.

What is claimed is:

1. A duplex printing apparatus for printing, with a single digital printer, on both surfaces of a web of paper for rotary printing traveling over between a paper supply unit and a paper takeup unit, characterized in that it comprises:

a pair of feed roll units arranged across the digital printer from each other in a direction of travel of the web of paper and each adapted to be driven synchronously with the paper supply and takeup units for feeding the web of paper to travel forwards and backwards while an upper surface of the web of paper faces an under surface of the digital printer;

a turnover unit arranged at one of a site between the paper supply unit and the feed roll unit on the paper supply side and a site between the paper takeup unit and the feed roll unit on the paper takeup side, whereby the web of paper is turned over through, and is allowed to bypass, a turnover path of the turnover unit;

a mark sensor arranged on at least one of sides across the digital printer from each other in a direction of travel of the web of paper and upstream in a direction of travel of the web of paper, an upper surface of which is being printed on by the digital printer, for detecting a timing mark which has been printed by the digital printer on an under surface of the web of paper; and a control unit operable in response to a detection value from the mark sensor for controlling the digital printer so that on the upper surface of the web of paper there is printed an image corresponding to an image that has been printed on the under surface of the web of paper.

2. A duplex printing apparatus for printing, with a single digital printer, on both surfaces of a web of paper for rotary printing traveling over between a paper supply unit and a paper takeup unit, characterized in that it comprises:

a pair of feed roll units arranged across the digital printer from each other in a direction of travel of the web of paper and each adapted to be driven synchronously with the paper supply and takeup units for feeding the web of paper to travel forwards and backwards while an upper surface of the traveling web of paper faces an under surface of the digital printer;

a turnover unit whereby the web of paper fed from one of the paper supply and takeup units on one side is detoured around the digital printer and turned over to travel into the feed roll unit on the other side and is then fed to travel from the feed roll unit on the other side into the feed roll unit on the one side while an upper surface of the web of paper faces an under surface of the digital printer, and thereafter the web of paper from the feed roll unit on the one side is turned over again and threaded into the other of the paper supply and takeup units, and the web of paper is also allowed to bypass the turnover unit;

a mark sensor arranged on at least one of sides across the digital printer from each other in a direction of travel of the web of paper and upstream in a direction of travel of the web of paper, an upper surface of which is being printed on by the digital printer, for detecting a timing mark which has been printed by the digital printer on an under surface of the web of paper; and a control unit operable in response to a detection value from the mark sensor for controlling the digital printer so that on the upper surface of the web of paper there is printed an image corresponding to an image that has been printed on the under surface of the web of paper.

3. A duplex printing apparatus as set forth in claim 1 or claim 2, characterized in that it further comprises a travel distance detector for detecting a travel distance of the web of paper traveling with respect to the digital printer, the control unit being adapted to receive detection values by the travel distance detector and signals from the mark sensor to control timing of printing on the under surface.

* * * * *